US005358586A

United States Patent [19]

Schutz et al.

[11] Patent Number: 5,358,586

[45] Date of Patent: Oct. 25, 1994

[54] AGING RESPONSE AND UNIFORMITY IN BETA-TITANIUM ALLOYS

[75] Inventors: Ronald W. Schutz, Canfield; Stanley R. Seagle, Warren, both of Ohio

[73] Assignee: RMI Titanium Company, Niles, Ohio

[21] Appl. No.: 991,989

[22] Filed: Dec. 17, 1992

Related U.S. Application Data

[62] Division of Ser. No. 806,077, Dec. 11, 1991.

[51] Int. Cl.[5] ..... C22C 14/00

[52] U.S. Cl. ..... 148/671; 148/421; 420/417; 420/421

[58] Field of Search ..... 148/671, 421; 420/417, 420/421

[56] References Cited

U.S. PATENT DOCUMENTS

| | | | |
|---|---|---|---|
| 4,799,975 | 1/1989 | Ouchi et al. | 148/671 |
| 4,859,415 | 8/1989 | Shida et al. | 420/418 |
| 4,889,170 | 12/1989 | Mae et al. | 148/671 |
| 5,171,375 | 12/1992 | Wakabayashi et al. | 148/671 |

*Primary Examiner*—Upendra Roy

*Attorney, Agent, or Firm*—Scully, Scott, Murphy & Presser

[57] ABSTRACT

The invention relates to a process for improving the aging response and uniformity in a beta titanium alloy comprising the steps of:

(a) cold working said beta titanium alloy to at least about 5% so that a reasonable degree of recrystallization can be obtained during subsequent solution treatment;

(b) pre-aging said cold worked alloy at about 900° to about 1300° F. for a time in excess of about 5 minutes to obtain a pre-aged alloy;

(c) solution treating said pre-aged alloy at a time and temperature to achieve a reasonable degree of recrystallization of said pre-aged alloy above the beta transus; and (d) aging said solution treated alloy at temperature and times to achieve a pre-aged, solution treated and aged beta titanium alloy substantially in a state of metallurgical equilibrium.

6 Claims, 2 Drawing Sheets

(100X)

(100X)

AGING RESPONSE AND UNIFORMITY IN BETA-TITANIUM ALLOYS

This is a divisional of copending application Ser. No. 806,077, filed on Dec. 11, 1991.

DESCRIPTION

1. Technical Field

The technical field to which the invention relates is titanium alloys and especially beta titanium alloys and the process for preparing such alloys to improve physical properties.

2. Prior Art

Hot worked beta titanium alloys are often cold worked to near or final form. In addition to achieving improved yields and near-net product forms, cold working is performed to produce high strength levels and/or improved ductility-strength property relationships in these alloys. This enhanced property combination occurs as a direct result of recrystallization and refinement of the grain structure.

Beta-titanium alloys are well known in the art. The beta alloys, once cold worked, are either direct aged (DA) for high strength properties or solution treated and aged (STA) for improved ductility at a given strength level. Ankem et al., *Beta Titanium Alloys in the 80's*, AIME, Warrendale, Pa., 1984, pp. 107–126; Ouchi et al., European Patent Appln. 87 114 617.1, 1987. The STA process offers a more refined, recrystallized grain structure, which results in enhanced ductility and reduced property directionality (anisotropy) compared to the DA process.

The STA process, may exhibit serious drawbacks when beta alloy aging response is sluggish after the solution treating period. ! :This sluggish age problem, especially prominent with solute-rich beta titanium alloys such Ti-3Al-8V-6Cr-4Zr-4Mo (Beta-C TM) and Ti-13V-11Cr-3Al, manifests itself as non-uniform or blotchy aging, requiring exceptionally long age cycles to achieve strength aims. Ankem et al., supra; Duerig et al., *Beta Titanium Alloys in the 80's*, AIME, Warrendale, PA, 1984, pp. 19–67. Other solute rich, metastable beta alloys include Ti-8V-8Mo-2Fe-3Al.

Solute-rich beta titanium alloys are generally defined as metastable beta alloys which are too stable to decompose isothermally to a beta and omega phase mixture, as distinguished from solute-lean alloys which form an omega phase during aging.

These solute rich alloys exhibit a phase separation reaction in which the beta-phase decomposes into two body centered cubic (b.c.c.) phases, one solute rich and the other solute lean, the solute lean phase being designated beta-prime. Additionally, the alpha-phase nucleation kinetics are slower in the solute-rich alloys, which means that longer aging times are required to achieve peak strength. The reasons for this include the typically lower aging temperatures used for these alloys because of the lower beta-transus, and the greater amount of diffusion that is required to disperse the higher concentration of beta-stabilizing solutes during formation of the alpha-phase precipitates.

These stabilizers more specifically comprise beta stabilizers which are stabilizers that decreases the beta transus. (Those stabilizers that increase the beta transus are described as alpha stabilizers). The two types of beta stabilizers which comprise the beta-isomorphous elements including Mo, V, Cb and Ta and the beta-eutectoid elements, Mn, Fe, Cr, Co, W, Ni, Cu and Si. The important alpha stabilizers include aluminum, tin, zirconium and the interstitial elements (those that do not occupy lattice positions), oxygen, nitrogen and carbon.

As noted previously the beta phase crystal structure is b.c.c. and is sometimes described as a high temperature allotropic phase of titanium. The alpha phase is an equilibrium phase with an hexagonal close packing (hcp) crystal structure that forms when the metastable beta alloys are heat treated below the beta transus. There are two types of alpha phase precipitates: Type 1 and Type 2. Type 1 alpha has a Burgers (crystallographic) orientation relationship with the beta phase and Type 2 alpha has no Burgers orientation relationship.

The omega phase is a metastable phase which forms in solute lean metastable beta alloys whenever the direct formation of alpha is difficult. The omega phase can form isothermally or athermally. The athermal omega phase is trigonal in heavily beta stabilized alloys, but becomes hexagonal in leaner alloys.

Beta prime is a solute lean metastable phase which forms in solute rich metastable beta titanium alloys where the omega phase formation is suppressed. The formation of beta prime is known as phase separation whereby the beta phase is converted into a mixture of beta prime and beta phases.

In metastable beta titanium alloys, to retain the beta phase it is not necessary to stabilize with alloying elements to the degree of decreasing of the beta transus to below room temperature. The alloys which contain beta stabilizers in quantities sufficient to reduce the martensitic transformation temperature to below room temperature but insufficient to reduce beta transus to below room temperature are known as metastable beta titanium alloys. Stable beta titanium alloys theoretically have sufficient quantities of beta stabilizers so that the beta transus can be reduced to below room temperature and aging is not possible.

Heavy and/or coarse precipitation of alpha phase on grain boundaries, known as grain boundary alpha, and on the precipitate networks is often symptomatic of the sluggish age problem in solute-rich beta alloys, which manifests itself as non-uniform or blotchy aging which requires exceptionally long age cycles to achieve strength. Duerig et al., supra. The extended age time becomes impractical, non productive and very costly with respect to mill product production. More importantly, the non uniform, incomplete alloy age may preclude achievement of required strength levels and other properties, while producing products that exhibit severe thermal instability with time under hot service conditions. Excess grain boundary alpha precipitation is also known to detrimentally influence alloy ductility, fatigue strength and stress corrosion cracking resistance in alpha-beta and beta titanium alloys. Duerig et al., supra.

The present invention relates to a process for improving the aging response and uniformity of beta titanium alloys or solute-rich beta titanium alloys. This process comprises the steps of cold working, pre-aged heat treatment, solution treatment, and a final age heat treatment of beta titanium alloys.

The beta titanium alloys can contain any mixture of the following elements: Al, V, Mo, Cr, Si, Zr and Pd or other Pt group metals. In the case wherein the alloy contains Pd or other Pt group metal, it is preferred that the concentration of these elements be less than or equal to 0.1 wt. %. The present invention also provides for the production of novel beta titanium alloys.

Several prior art methods have been disclosed for heat-treating cold-worked beta titanium alloys. For example, Ouchi et al., *Sixth World Conference on Titanium,* France 1988, pp. 819–824 describes a strengthening mechanism of ultra-high strength achieved by new processing in beta titanium alloys which consists of a first cold rolling step followed by a first solution treatment step and then a second cold rolling step and a second solution treatment step followed by an aging step. Ouchi et al., European Patent Appln. 0 263 503 contains substantially the same teachings.

Okada, *Sixth World Conference on Titanium,* France 1988, pp. 1625–1628 also describes a so-called two step aging process for strengthening a beta titanium alloy in which cold rolled sheets are solution-treated and followed by a duplex age treatment to improve aging response and hardenability.

SUMMARY OF THE INVENTION

The present invention comprises a novel process for substantially improving the aging response in a beta titanium alloy containing at least about 80 ppm Si and at least about 500 ppm Zr comprising the steps of:

(a) cold working said beta-titanium alloy to at least about 5% so that a reasonable degree of recrystallization can be obtained during subsequent solution treatment and thereby produce a cold worked alloy;

(b) pre-aging said cold worked alloy at from about 900° F. to about 1300° F. for a time in excess of about five minutes to obtain a pre-aged alloy;

(c) solution treating said pre-aged alloy at a temperature and for a time to achieve a reasonable degree of recrystallization of said pre-aged alloy above the beta transus and to also obtain substantially maximum ductility and substantially minimum non uniform aging thereby producing a solution treated alloy;

(d) aging said solution treated alloy at from about 900° F. to about 1200° F. for a period of time of from about 6 to about 36 hours to obtain a pre-aged, solution treated and aged beta-titanium alloy substantially in a state of metallurgical equilibrium.

BRIEF DESCRIPTION OF THE DRAWINGS

FIGS. 3*a* and 3*b* comprise transverse section photomicrographs of a 50% cold worked Pd-enhanced Beta-C TM manufactured according to the STA process of the prior art (FIG. 3*a*) and the PASTA process of the present invention (FIG. 3*b*).

FIG. 4 comprises an age profile (Rockwell-C Hardness vs. aging time) for a 50% cold worked Beta-C TM alloy piping using the prior art STA process compared to the PASTA process of the invention.

DETAILED DESCRIPTION OF THE INVENTION

Figure 1:
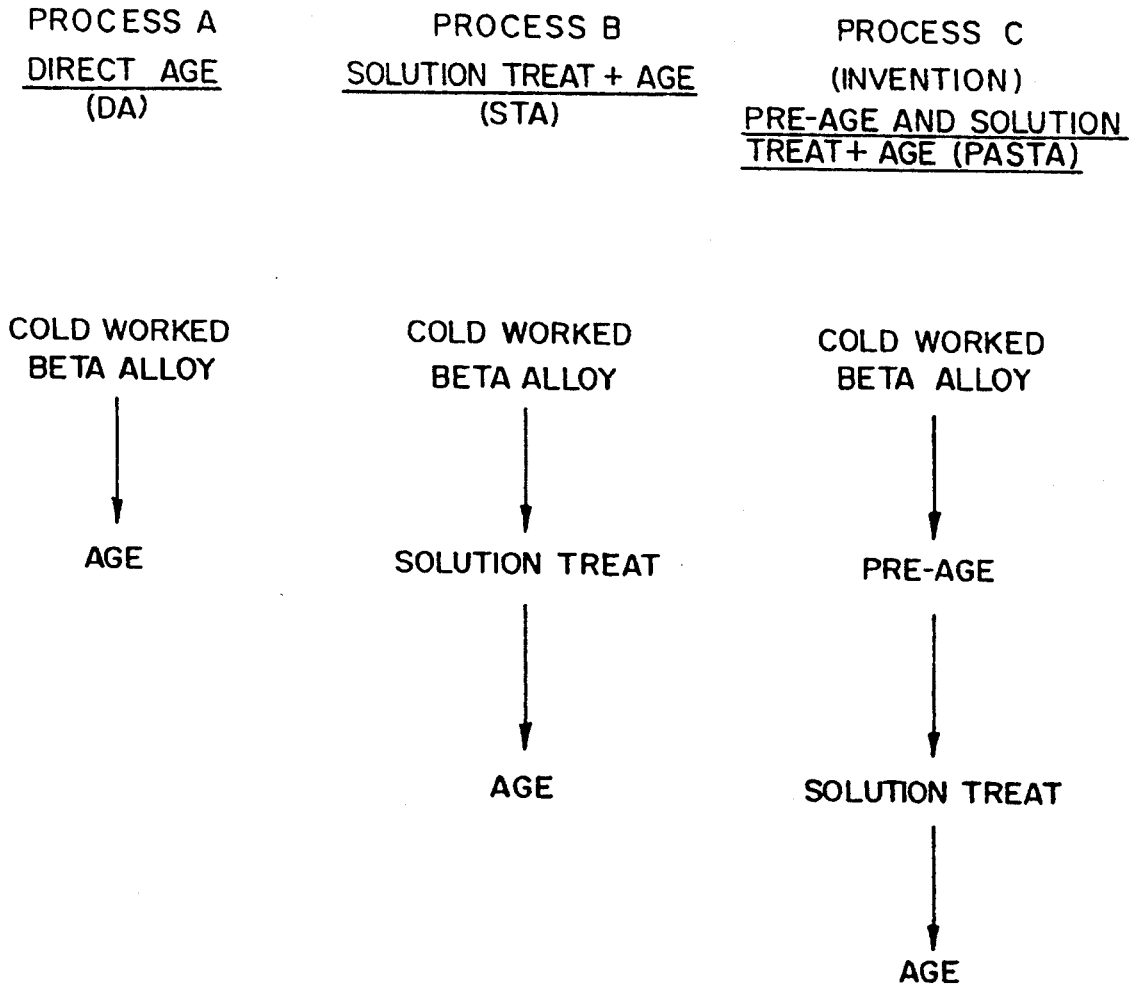
FIG. 1 comprises a schematic illustration of thermal processing treatments for achieving medium to high strength levels in cold worked beta titanium alloys by the DA process, the STA process and the process of the present invention comprising the steps of pre-aging, solution treating and aging (hereinafter "PASTA").

The present invention comprises the steps of cold working followed by a pre-age heat treatment, then solution treating and aging a beta-titanium alloy, especially a solute-rich metastable beta-titanium alloy and as such offers a practical alternative processing route for consistently enhancing the rate and uniformity of aging of cold worked and solution treated beta-titanium alloys. This improved heat treat method outlined in FIG. 1 as process C is primarily effective on beta titanium alloys containing at least minor concentrations of both Zr and Si.

By employing this process, a relatively stable beta titanium product can be made not only in less time but also with the attendant advantage of superior properties compared to the art known methods of producing these alloys. This offers the dual benefit of economics of production plus improved properties.

The relative property improvements achievable in beta titanium alloys with the PASTA process over the conventional prior art DA and STA processes are indicated in Table 1 which follows.

TABLE 1

Relative Characteristics of Cold Worked Beta Alloy Products After Various Heat Treatment Processes

| CHARACTERISTIC | PROCESS A (DA) | PROCESS B (STA) | (INVENTION) PROCESS C (PASTA) |
|---|---|---|---|
| Age Uniformity | ++ | +− | ++ |
| Age Response | + | +− | + |
| Strength | ++ | +− | + |
| Ductility | − | + | + |
| Thermal Stability | + | − | + |
| Directionality | − | + | + |

"+" indicates superior or enhanced characteristic/condition
"−" indicates inferior characteristic/condition Table 1 clearly illustrates improved age response and uniformity, favorable strength and ductility and diminished thermal instability and directionality which can be obtained by utilization of the PASTA treatment process.

Figure 2A:
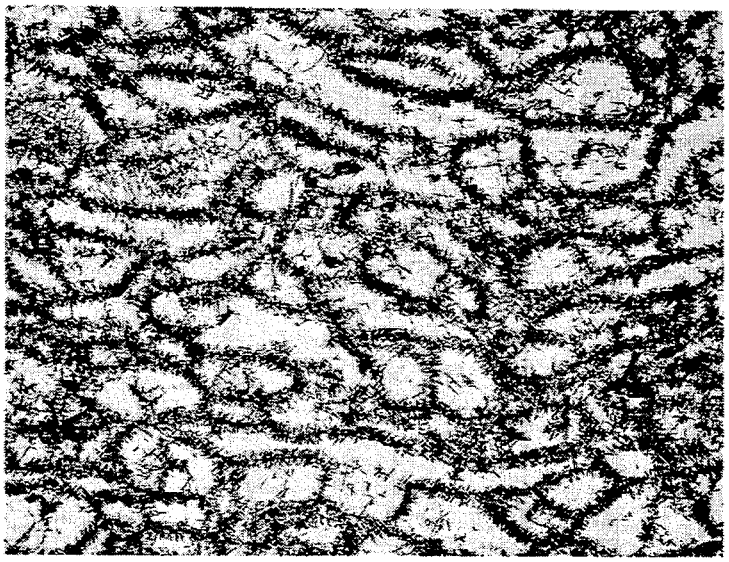
FIGS. 2*a* and 2*b* comprise transverse section photomicrographs of a 51% cold worked standard Beta-C TM made by the STA process of the prior art (FIG. 2*a*) and by the PASTA process of the present invention (FIG. 2*b*).
Figure 2B:
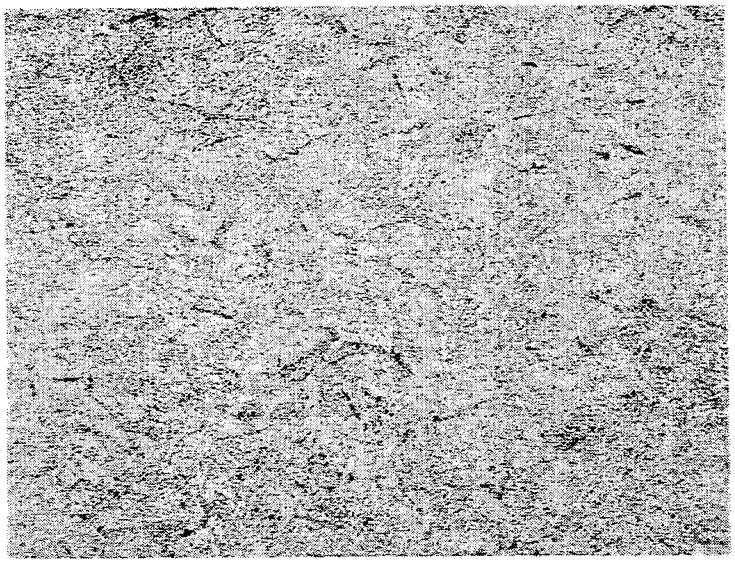

Referring to FIGS. 2 and 3, it can be seen that significant improvement in degree and uniformity of aging can be achieved in the Beta-C TM alloy with the PASTA process as compared to the traditional STA treatment. The white, light blotchy zones within the microstructure evident in FIGS. 2*a* and 3*a* represent unaged beta phase, which can be thermally unstable and subject to continued aging at temperatures above 350° F. as noted by Ankem et al.

This improvement in degree of alpha phase precipitation provided by the PASTA process is quantitatively reflected in the significantly increased percent volume fraction of alpha phase values listed in Examples 1 and 2 which follow.

The following examples are of comparative Beta-C TM pipe product properties achieved from using the different heat treat processes.

EXAMPLE 1:
Standard Beta-C TM 2.875" OD × 0.217" AW Pipe
Cold Pilgered 51.3%
Ti—3.6Al—8.1V—5.9Cr—4.3Zr—4.4Mo—0.080$_2$—0.03Si

| PROPERTIES | PROCESS B (STA) | PROCESS C (PASTA) |
|---|---|---|
| YS (ksi) | 134 | 140 |

-continued

EXAMPLE 1:
Standard Beta-C TM 2.875" OD × 0.217" AW Pipe
Cold Pilgered 51.3%
Ti—3.6Al—8.1V—5.9Cr—4.3Zr—4.4Mo—$0.080_2$—0.03Si

| PROPERTIES | PROCESS B (STA) | PROCESS C (PASTA) |
|---|---|---|
| UTS (ksi) | 139 | 147 |
| Elong. (%) | 21.9 | 21.9 |
| RA (%) | 51.8 | 50.0 |
| Hardness ($R_c$) | 30.0 | 32.3 |
| $\alpha/\beta$ vol. fraction (%) | 46 | 71 |
| Microstructure | (FIG. 2a) | (FIG. 2b) |

Process B (STA) involves solution treating the alloy at 1500° F. for 15 min. then air cooling and aging at 1050° F. for 24 hrs. followed by cooling in air.

Process C (PASTA) involves pre-aging the material at 1150° F. for 15 min. followed by air cooling, and a final aging treatment at 1050° F. for 24 hrs. followed by cooling in air.

EXAMPLE 2:
Pd-Enhanced Beta-C TM 2.875" OD × 0.276" AW Pipe
Cold Pilgered 50%
Ti—3.1Al—7.9V—6.0Cr—4.0Zr—4.2Mo—$0.080_2$—0.04 Si—0.06Pd

| PROPERTIES | PROCESS B (STA) | PROCESS C (PASTA) |
|---|---|---|
| YS (ksi) | 137 | 145 |
| UTS (ksi) | 142 | 153 |
| Elong. (%) | 19.0 | 18.7 |
| RA (%) | 49.1 | 47.2 |
| Hardness ($R_c$) | 33.0 | 35.0 |
| $\alpha/\beta$ vol. fraction (%) | 56 | 83 |
| Microstructure | (FIG. 3a) | (FIG. 3b) |

Process B (STA) involves solution treating the alloy at 1500° F. for 30 min. then air cooling and aging at 1050° F. for 24 hrs. followed by air cooling.

Process C (PASTA) involves pre-aging the alloy at 1150° F. for 1 hr. then air cooling followed by solution treatment at 1500° F. for 30 min. then air cooling and a final aging treatment at 1050° F. for 24 hrs. followed by air cooling.

EXAMPLE 3:
Standard Beta-C TM 5.0" OD × 0.576" AW Pipe
Cold Pilgered 51%
Ti—2.7Al—7.6V—5.9Cr—4.0Zr—3.8Mo—$0.090_2$—0.03Si

| | PROCESS A (DA) | | PROCESS C (PASTA) | |
|---|---|---|---|---|
| PROPERTIES | L* | T** | L* | T** |
| YS (ksi) | 145 | 149 | 147 | 149 |
| UTS (ksi) | 153 | 154 | 155 | 156 |
| Elong. (%) | 17.9 | 12.5 | 19.3 | 17.2 |
| RA (%) | 33.6 | 20.7 | 39.3 | 34.0 |
| Hardness ($R_c$) | 33.5 | | 34.5 | |

*L = longitudinal orientation
**T = transverse orientation

Process A (DA) involves only aging the alloy at 1200° F. for 4 hrs. followed by air cooling.

Process C (PASTA) involves pre-aging the alloy at 1150° F. for 1 hr. then air cooling followed by solution treatment at 1500° F. for 15 min. then air cooling and a final aging treatment at 1050° F. for 24 hrs. and air cooling.

The more favorable age response facilitated by the PASTA process is graphically depicted in FIG. 4 for the Beta-C TM alloy. The significantly diminished age times required to achieve a given strength and hardness level with the PASTA process treatment compared to that of the standard STA treatment is clearly illustrated. The reduced aging time to reach a strength level "plateau" clearly shows a more rapid attainment of substantially complete metallurgical equilibrium i.e. a complete age, at age temperatures. This decreased time to a substantially fully aged condition also assures that thermal stability may be achieved in the alloy within practical heat treatment cycles.

The PASTA treatment process can also provide a favorable ductility/strength relationship in beta titanium alloys as revealed in Examples 1-3. Examples 1 and 2 demonstrate that favorable ductility (% EL and RA) is maintained with the PASTA treatment process while achieving increased strength levels compared to those obtained from the prior art STA treatment. When compared to the other standard prior art DA process treatments, the PASTA process does not produce the low ductility values along with the relatively large degree of property anisotropy (directionality) noted in Example 3. This undesirable directionality was especially apparent in T-direction ductility values of Process A but was minimal with the Process C (PASTA) treatment.

Although the inventors do not want to be limited by any theory, it is believed that the improvement in age response and uniformity produced by the PASTA treatment involves a fine silicide precipitate in certain beta titanium alloys. Specifically, beta alloys containing at least about 80 ppm Si and at least about 500 ppm Zr are known to form complex $(TiZr)_5Si_3$silicide precipitates as described by Ankem, et al., *Met. Trans A,* Vol. 18A, Dec. 1987, pp. 2015-2025; Headley et al., *Met. Trans A,* Vol. 10A, July 1979, pp. 909-920. In Beta-C TM alloy mill products, normal background levels of silicon are sufficient to precipitate the silicides below 1925° F. Ankem et al., supra.

In the PASTA process treatment, the pre-aged serves to rapidly nucleate and grow fine, alpha precipitates in a uniform, high density distribution at high energy sites created by cold working. Upon subsequent heating to solution treat temperatures, it is believed that silicide (HCP) precipitates preferably nucleate and grow on these alpha (HCP) precipitates which persist below the beta transus of the alloy. Continued heating at solution treat temperatures continues to grow and coarsen these silicide precipitates.

Upon final aging, this fine, uniform distribution of silicide precipitates serves as a favorite template for alpha phase nucleation and growth.

The case for a silicide precipitate aging enhancement mechanism is supported by solution treat studies on Beta-C TM alloy. Furthermore, the improved age response and uniformity produced by the PASTA process is not significantly affected by increasing solution treat temperature (up to about 1600° F.) and time (up to about 1 hour). This tends to rule out a mechanism based on alpha phase or dislocation residues formed during the pre-age, surviving the solution treat step to facilitate final aging. The silicide precipitate is the only currently known phase existing in the Beta-C TM alloy which can survive these solution treat conditions and promote aging.

If solution temperatures and times are chosen sufficiently high enough to permit relatively complete recrystallization, optimum ductility-strength property relationships as illustrated in Table 2 can be expected.

This is generally achieved at temperatures above about 1450° F. for times greater than about 15 minutes in the Beta-C TM alloy. Solution treat temperatures and times below that required for recrystallization will reduce ductility, increase strength and approach direct age treatment properties.

The beta titanium alloy must contain at least about 80 ppm Si and at least 500 ppm Zr; especially from about 80 ppm to 1000 ppm Si and from about 500 ppm to about 50,000 ppm Zr and more particularly from about 100 ppm to about 400 ppm Si and from about 500 ppm to about 30,000 ppm Zr.

Beta titanium alloys that may be treated according to the process of the present invention include not only those specifically set forth herein but also the Beta III (Ti 11.5Mo-6Zr-4.5Sn) alloy.

The beta alloy must be cold worked to at least about 5% or greater. Cold working in a range of from about 25 to about 55% is preferred to enhance final age uniformity and achieve a reasonable degree of recrystallization during solution treatment.

The pre-age treatment is performed at a temperature from about 900° F. to about 1300° F. for times in excess of about 5 minutes and cooled by any conventional method known in the art. Preferred temperatures are from about 1050° F. to about 1200° F. with times from about 1 hour to about 8 hours.

Once pre-aged the alloy is subsequently solution treated and aged using standard heat treatments. The beta solution treat temperature is generally chosen sufficiently high to achieve relatively complete recrystallization above the beta transus, thereby maximizing ductility and minimizing non uniform aging. By way of example, at temperatures from about 1450° F. to about 1600° F. and times of from about 15 minutes or more may be employed as typical solution treatments of Beta-C TM alloy. Times ranging from about 15 minutes to about 120 minutes and especially from about 15 minutes to about 30 minutes are especially suitable in this regard.

It should be noted, however, that there are two types of solution treatments, beta solution treatment and alpha-beta solution treatment both of which can be employed according to the process of the present invention depending on what type of beta titanium alloy is subjected to the novel process of the invention. The beta solution treatment consists of heating the alloy to about 15° C. to about 110° C. (25°–200° F.) above the beta transus and keeping the alloy at this temperature for a time of from about 0.5 to about 2 hours, followed by air cooling or water quenching. The alpha-beta solution treatment consists of heating the material to about 15° C. to about 75° C. (25°–125° F.) below the beta transus followed by water quenching or air cooling. Normally, the beta-solution treatment results in the formation of a recrystallized beta phase. In the Beta-C TM alloy, the beta-solution treatments may result in beta phase along with unidentified second phase particles.

The alpha-beta solution treatments result in beta along with a small volume fraction of equilibrium alpha phase occupying both the beta grain boundaries and beta grain interiors. To control the prior grain size, an alpha-beta solution treatment is used because the alpha precipitates can act as grain growth inhibitors. In solute rich beta alloys such as Ti-13V-11Cr-3Al, the strength that can be achieved by aging of the alpha-beta solution treatment is limited because the resultant beta phase tends to be stable and upon aging only a limited alpha precipitation occurs. Accordingly the type of solution treatment depends on the alloy and the property requirements.

After cooling by conventional means, standard beta titanium age treatments are employed typically from about 900° F. to about 1200° F. for a period of time from about 6 to about 36 hours to achieve required alloy strength levels.

Essentially there are three types of aging treatments that may be used according to the invention which comprise high temperature aging-short time; low temperature aging-long time, and duplex aging-low temperature aging followed by high temperature aging.

High temperature aging consists of heating the alloy to about 85° C. to about 230° C. (150°–450° F.) below the beta transus for short times (normally less than about 24 hours). This treatment results in the precipitation of alpha particles, the size and quantity of which depend on the alloy and the time at the aging temperature. The higher temperature, the coarser the alpha particles. Apart from the formation of alpha, intermetallic compounds can form if the alloys contain sufficient quantities of beta-eutectoid alloying elements.

Low temperature aging is usually conducted in the temperature range from about 200° C. to about 450° C. (about 392° F. to about 842° F.). In many cases, depending on the type of alloy, very long times, greater than about 50 hours, are necessary to complete the transformation sequences in solute-rich metastable beta titanium alloys such as Beta-C TM alloy or Ti-13V-11Cr-3Al and result in homogeneous precipitation of alpha phase. Additionally, intermetallic compounds can form such as $TiCr_2$ in the alloy Ti-13V-11Cr-3Al.

Duplex aging is employed to control the size and distribution of alpha phase precipitates. The treatment consists of a short time, low temperature aging followed by high temperature aging. The aim of the duplex aging is to take advantage of the homogenous precipitation of omega or beta prime and to homogeneously nucleate alpha phase at the beta-omega or beta-prime phase boundaries. The advantage of duplex aging over straight low temperature aging is that long heat treatment times are not necessary.

The process of the invention is used to obtain novel beta titanium alloy products which may be used in various industrial applications such as tubulars and casings for oil field and geothermal well use, and in structural applications such as strengthening members for aircraft and space vehicles as well as aircraft skin and space vehicle skin, springs, and fasteners.

What is claimed is:

1. A beta-titanium alloy product having high strength, ductility, thermal stability and accelerated but uniform aging response formed by the steps comprising:

(a) cold working a beta-titanium alloy to at least about 5%, said alloy comprising at least 500 ppm Zr and at least 80 ppm Si;

(b) pre-aging said cold worked alloy at a temperature of about 900° F. to about 1300° F. for a period of time in excess of about 5 minutes to obtain a pre-aged alloy;

(c) solution treating said pre-aged alloy at a low temperature and for a sufficient time to achieve a reasonable degree of recrystallization of said pre-agent alloy above the beat transus and to also obtain substantially maximum ductility and substantially minimal non-uniform aging, and thereby produce a solution treated alloy; and (d) aging said solution treated alloy at a temperature of about 900° F. to about 1200° F. for a period of time of about 6 to about 36 hours, to obtain a pre-aged, solution-treated and aged alloy substantially in a state of metallurgical equilibrium.

2. The product of claim 33 wherein said beta-titanium alloy comprises from about 500 ppm to about 50,000 ppm Zr and from about 80 ppm to about 1000 ppm Si.

3. The product of claim 1 wherein said beta-titanium alloy is a solute-rich alloy containing Al, V and Cr.

4. The product of claim 1 wherein said beta-titanium alloy is a solute-rich alloy containing Al, V, Cr and Mo.

5. The product of claim 2 wherein said beta-titanium alloy comprises rom about 500 ppm to about 30,000 ppm Zr and from about 100 ppm to about 400 ppm Si.

6. The product of claim 4 wherein said beta titanium alloy further contains Pd or other platinum group metals.

* * * * *

UNITED STATES PATENT AND TRADEMARK OFFICE

CERTIFICATE OF CORRECTION

PATENT NO. : 5,358,586

DATED : October 25, 1994

INVENTOR(S) : Ronald W. Schutz, et al.

It is certified that error appears in the above-indentified patent and that said Letters Patent is hereby corrected as shown below:

Formal Drawings, insert the following:

--

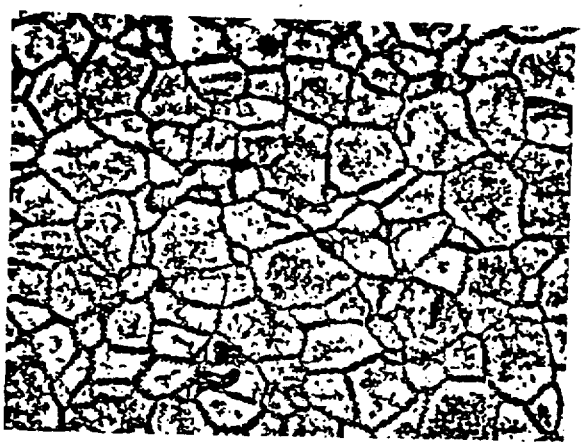

FIG. 3a (100X)

UNITED STATES PATENT AND TRADEMARK OFFICE

CERTIFICATE OF CORRECTION

PATENT NO. : 5,358,586

DATED : October 25, 1994

INVENTOR(S) : Ronald W. Schutz, et al.

It is certified that error appears in the above-indentified patent and that said Letters Patent is hereby corrected as shown below:

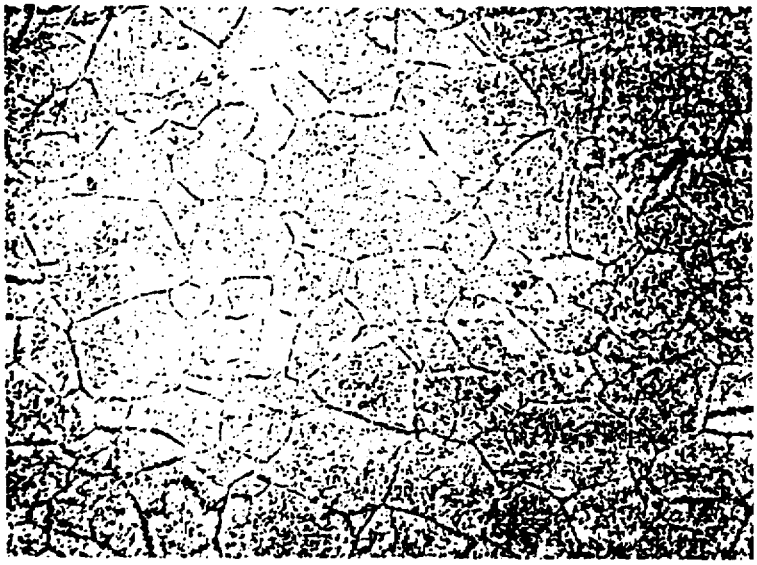

FIG. 3b (100X)

UNITED STATES PATENT AND TRADEMARK OFFICE

CERTIFICATE OF CORRECTION

PATENT NO. : 5,358,586

DATED : October 25, 1994

INVENTOR(S) : Ronald W. Schutz, et al.

It is certified that error appears in the above-indentified patent and that said Letters Patent is hereby corrected as shown below:

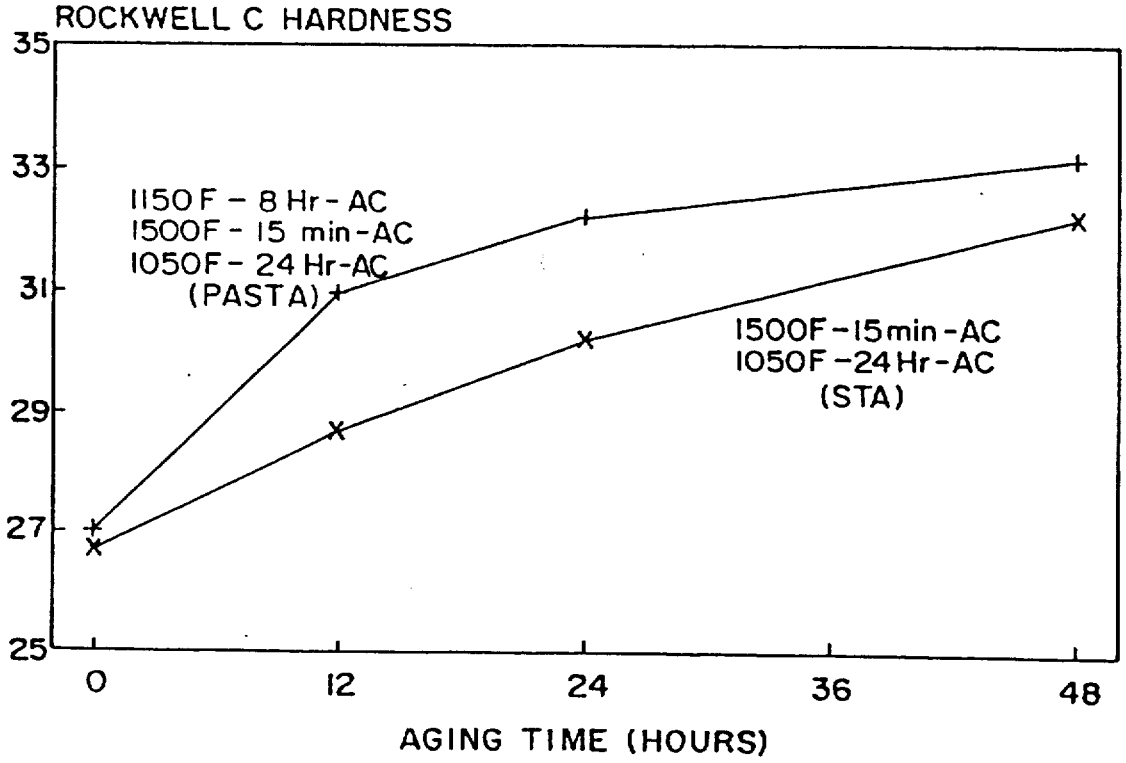

FIG. 4

--

UNITED STATES PATENT AND TRADEMARK OFFICE

CERTIFICATE OF CORRECTION

PATENT NO. : 5,358,586

DATED : October 25, 1994

INVENTOR(S) : Ronald W. Schutz, et al.

It is certified that error appears in the above-indentified patent and that said Letters Patent is hereby corrected as shown below:

Column 1, line 36: after "period." delete --! :--

Column 5, line 18: "15 min." should read --8 hrs.--

Column 8, line 64, Claim 1: "pre-agent" should read --pre-aged--

Column 8, line 65, Claim 1: "beat" should read --beta--

Column 9, line 8, Claim 2: "claim 33" should read --claim 1--

Column 10, line 5, Claim 5: "rom" should read --from--

Signed and Sealed this

Fourteenth Day of May, 1996

*Attest:*

*Attesting Officer*

BRUCE LEHMAN

*Commissioner of Patents and Trademarks*